US006038737A

United States Patent [19]

Boright

[11] Patent Number: 6,038,737

[45] Date of Patent: Mar. 21, 2000

[54] SPRING HINGED ACTUATOR

[76] Inventor: Jerry N. Boright, 2 Tina La., No. 219, Naples, Fla. 34104

[21] Appl. No.: 08/953,739

[22] Filed: Oct. 20, 1997

[51] Int. Cl.[7] ..... E05F 1/08; E05D 11/06

[52] U.S. Cl. ..... 16/297; 16/374; 16/292

[58] Field of Search ..... 16/82, 297, 374, 16/375, 387, 292

[56] References Cited

U.S. PATENT DOCUMENTS

| | | | |
|---|---|---|---|
| 1,228,473 | 6/1917 | Panay | 16/297 |
| 1,715,590 | 6/1929 | Burhenne | 16/297 |
| 2,883,699 | 4/1959 | Gross | 16/387 |
| 3,459,462 | 8/1969 | Barnard et al. | 16/374 |
| 4,912,783 | 4/1990 | Safer | 16/82 |
| 5,762,374 | 6/1998 | Grove et al. | 280/847 |

FOREIGN PATENT DOCUMENTS

| | | | |
|---|---|---|---|
| 202578 | 9/1991 | Japan | 16/82 |
| 1455256 | 1/1973 | United Kingdom | 16/82 |
| 2158872 | 11/1985 | United Kingdom | 16/297 |

*Primary Examiner*—Brian K. Green
*Assistant Examiner*—Marcus Dolce
*Attorney, Agent, or Firm*—Merrill N. Johnson

[57] ABSTRACT

A spring-hinged actuator has a first attachment member (1) joined pivotally to a second attachment member (2) with a hinge (3). The first attachment member and the second attachment member are spring-tensioned pivotally on the hinge with at least one torsional spring (4, 5) fastened to the first attachment member. At least one base torsional extension (6, 8) of the torsional spring is positioned to direct base torsional-spring pressure against the first attachment member in a first rotational direction and to direct torsionally rotative spring pressure in an oppositely second rotational direction against the second attachment member. The first attachment member and the second attachment member have sides at a dihedral angle proximate an axis of the hinge. The dihedral angle is maintained in opposition to opposite-directionally rotative pressure from the torsional spring by a releasable tensioner (14) that is extended intermediate the first attachment member and the second attachment member. The first attachment member and the second attachment member can be structured for attachment to particular classes of targeted actuation items. The releasable tensioner is structured for release of the first attachment member and the second attachment member to actuate the targeted actuation items in reaction to predetermined conditions.

13 Claims, 1 Drawing Sheet

SPRING HINGED ACTUATOR

BACKGROUND OF THE INVENTION

1. Field of the Invention

This invention relates to spring-hinged actuators for actuating items such as doors, signals, explosive devices, initiators of motion, initiators of resistance to motion, alarms, traps and other items requiring spring-hinged actuation.

2. Relation to Prior Art

Known spring actuators do not have the versatility for use on a wide variety of items requiring spring actuation in a manner taught by this invention. An example of a different but related device illustrated in U.S. Design Pat. No. 375, 960, issued to Boright, depicts a link for a rotary motion device without a cocking or triggering means for making it operative.

SUMMARY OF THE INVENTION

Objects of this invention are to provide a spring-hinged actuator which:

Can be positioned on a wide selection of objects;

Is adaptable to a wide selection of release conditions;

Is highly reliable; and

Is inexpensive to produce.

This invention accomplishes these and other objectives with a spring-hinged actuator having a first attachment member joined pivotally to a second attachment member with a hinge. The first attachment member and the second attachment member are spring-tensioned pivotally on the hinge with at least one torsional spring fastened pivotally to the first attachment member. At least one base torsional extension of the torsional spring is positioned to direct base torsional-spring pressure against the first attachment member in a first rotational direction and to direct torsionally rotative spring pressure in an oppositely second rotational direction against the second attachment member. The first attachment member and the second attachment member have sides at a dihedral angle proximate an axis of the hinge. The dihedral angle is maintained in opposition to opposite-directionally rotative pressure from the torsional spring by a releasable tensioner that is extended intermediate the first attachment member and the second attachment member. The first attachment member and the second attachment member are structured for attachment to particular classes of targeted actuation items. The releasable tensioner is structured for release of the first attachment member and the second attachment member to actuate the targeted actuation items in reaction to predetermined conditions.

BRIEF DESCRIPTION OF DRAWINGS

This invention is described by appended claims in relation to description of a preferred embodiment with reference to the following drawings which are referred to as FIGS. in this document and described briefly as follows:

DESCRIPTION OF PREFERRED EMBODIMENT

Terms used to describe features of this invention are listed below with numbering in the order of their initial use with reference to the drawings. These terms and numbers assigned to them designate the same features wherever used throughout this description.

| | |
|---|---|
| 1. First attachment member | 10. Spring axle |
| 2. Second attachment member | 11. First U-bolt |
| 3. Hinge | 12. Second U-bolt |
| 4. First torsional spring | 13. Spring bracket |
| 5. Second torsional spring | 14. Releasable tensioner |
| 6. Base torsional extension of first torsional spring | 15. First tensioner orifice |
| | 16. Second tensioner orifice |
| 7. Rotational extension of first torsional spring | 17. Thin central section |
| | 18. Thin end sections |
| 8. Base torsional extension of second torsional spring | 19. Positioning shoulders |
| | 20. Central detector |
| 9. Rotational extension of second torsional spring | 21. End detectors |
| | 22. Fastener orifices |

Figure 1:
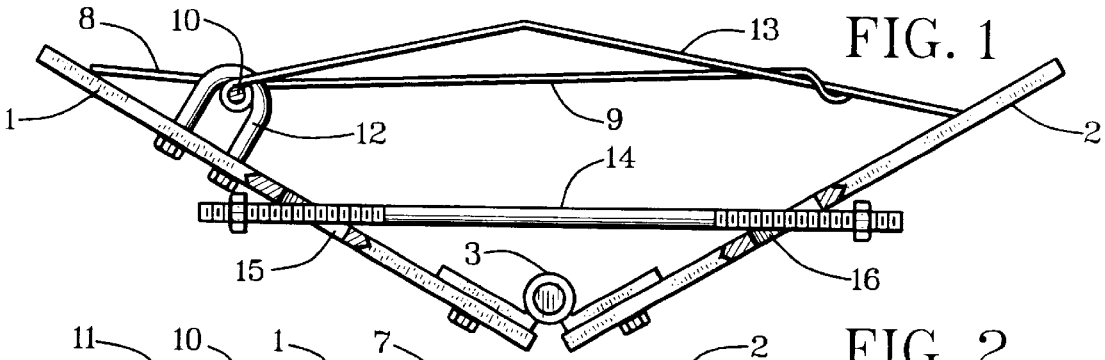
FIG. 1 is a partially cutaway side view of the spring-hinged actuator in a cocked mode.
Figure 2:
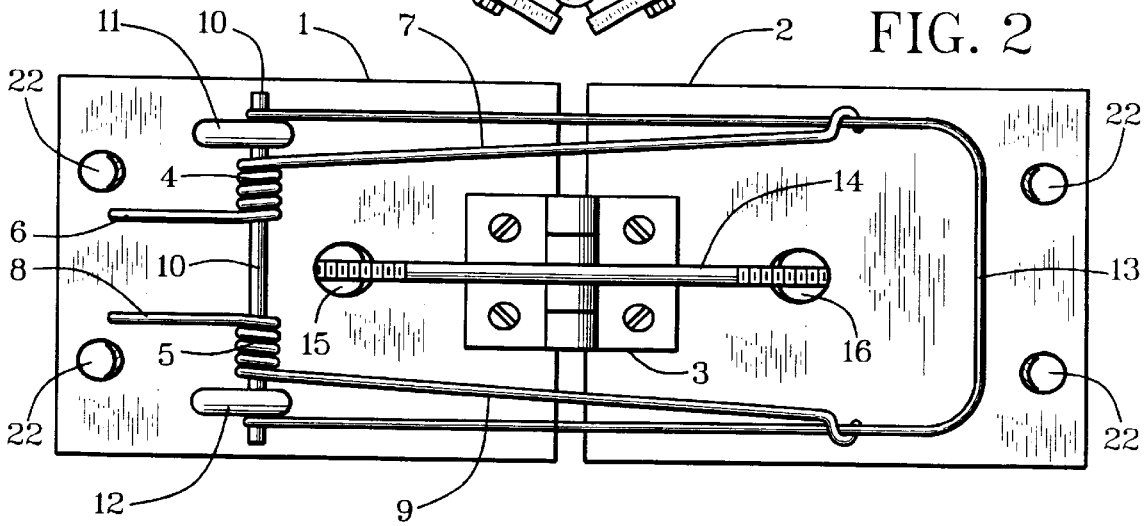
FIG. 2 is a top view of the FIG. 1 illustration.

Reference is made first to FIGS. 1–2. A first attachment member 1 is joined pivotally to a second attachment member 2 with a hinge 3. The first attachment member 1 and the second attachment member 2 are preferably plates that are tensioned pivotally in opposite-directional rotation on the hinge 3 with at least one torsional spring which is preferably a first torsional spring 4 and a second torsional spring 5.

A base torsional extension 6 of the first torsional spring 4 is positioned to direct base torsional-spring pressure against the first attachment member 1 in a first rotational direction and to direct torsionally rotative spring pressure of a rotational extension 7 of the first torsional spring 4 in an oppositely second rotational direction against the second attachment member 2. In tandem relationship, a base torsional extension 8 of the second torsional spring 5 is positioned to direct base torsional-spring pressure against the first attachment member 1 in the first rotational direction and to direct torsionally rotative spring pressure of a rotational extension 9 of the second torsional spring 5 in the oppositely second rotational direction against the second attachment member 2.

Coils of the first torsional spring 4 and the second torsional spring 5 are juxtaposed on an outside periphery of a spring axle 10. The spring axle 10 is contained in an axle housing that can be a pair of U-bolts, a first U-bolt 11 being extended upwardly from a first side of the first attachment member 1 and a second U-bolt 12 being extended upwardly from a second side of the first attachment member 1.

The rotational extensions 7 and 9 can be positioned directly against the second attachment member 2 for imparting opposite directional rotation of the second attachment member 2 from the first attachment member 1. Preferably, however, the rotational extensions 7 and 9 are connected to a spring bracket 13 having bracket legs attached pivotally to opposite ends of the spring axle 10.

Figure 6:
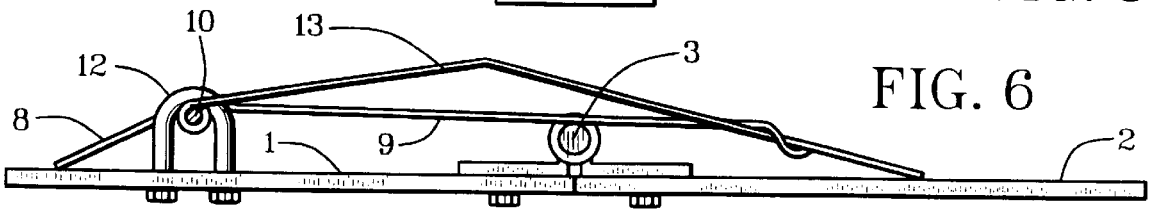
FIG. 6 is a side view of the spring-hinged actuator in a released mode.

The first attachment member 1 and the second attachment member 2 are maintained in a cocked mode at a dihedral angle by insertion of a releasable tensioner 14 in a first tensioner orifice 15 and in a second tensioner orifice 16 as depicted in FIGS. 1–2. A contrasting released mode is depicted in FIG. 6 with the first attachment member 1 and the second attachment member 2 not being maintained in dihedral relationship by the releasable tensioner 14.

Figure 3:
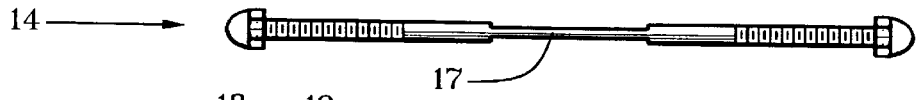
FIG. 3 is a side view of a releasable tensioner having a central yield section and cap bolts.
Figure 4:
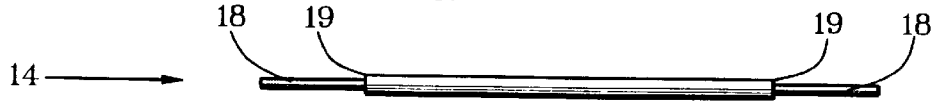
FIG. 4 is a side view of a releasable tensioner having end yield sections.
Figure 5:
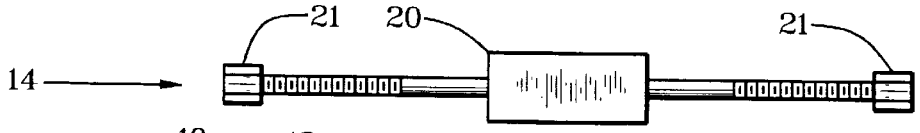
FIG. 5 is a side view of a releasable tensioner having a central yield section representing electrical, radio wave, chemical, sound, vibration, positional change, heat, chemical, ambient pressure, time, rotative pressure, bending moment and other select factors for release of the releasable tensioner.

Referring to FIGS. 3–5, the releasable tensioner 14 can be structured selectively for select applications of this spring-hinged actuator. A thin central yield section 17 can be structured to yield to heat or pressure for releasing the first attachment member 1 and the second attachment member 2 to rotate in opposite directions under pressure of the torsional springs 4 and 5 for actuating targeted items. Thin end sections 18 can provide positioning shoulders 19 in addition to predetermined yield of the thin end sections 18 for release of the releasable tensioner 14.

The releasable tensioner 14 illustrated in FIG. 5 is representative of a selection of release criteria related to factors such as electrical current, radio-wave signals, ambient chemical conditions, ambient pressure, altitude, vibration, acceleration, positional change, attitudinal change, sound, smoke and time. A central detector 20 and/or end detectors 21 can be structured for separate or for coactive operation.

Referring further to FIG. 2, attachment member 1 and attachment member 2 can be structured for attachment to a wide selection of targeted items for actuation. Included can be various rotational devices, alarms and signals. Applications can be not only to detect conditions but also to actuate mechanisms in response to detected conditions.

In combination with structure for attachment, fastener means are important. Representative of convenient structure are plate forms that are depicted with fastener orifices 22. Other forms of attachment members 1 and 2, other forms of fastening provision than the fastener orifices 22 and other types of springs are anticipated within this invention.

A new and useful spring-hinged actuator having been described, all such foreseeable modifications, adaptations, substitutions of equivalents, mathematical possibilities of combinations of parts, pluralities of parts, applications and forms thereof as described by the following claims and not precluded by prior art are included in this invention.

I claim:

1. A spring-hinged actuator comprising:

a first attachment member joined pivotally to a second attachment member with at least one hinge;

the first attachment member and the second attachment member being tensioned pivotally in opposite-directional rotation on the hinge with at least one torsional spring fastened to the first attachment member;

the at least one torsional spring having at least one base torsional extension of the torsional spring that is positioned to direct base torsional spring pressure against the first attachment member in a first rotational direction and to direct torsionally rotative spring pressure in an oppositely second rotational direction against the second attachment member;

the fist attachment member and the second attachment member having sides at a dihedral angle proximate an axis of the hinge in a cocked mode;

the dihedral angle being maintained in opposition to opposite-directionally rotative pressure from the torsional spring by a releasable tensioner that is extended intermediate the first attachment member and the second attachment member;

the first attachment member and the second attachment member are structured for attachment to particular classes of targeted actuation items;

the releasable tensioner is structured for release of the first attachment member and the second attachment member in reaction to a predetermined condition to actuate the targeted actuated items;

wherein the at least one torsional spring is a double torsional spring having a first torsional spring and a second torsional spring;

a base torsional extension of the first torsional spring is positioned to direct base torsional-spring pressure against the first attachment member in the first rotational direction and to direct torsionally rotative spring pressure of a rotational extension of the first torsional spring in the oppositely second rotational direction against the second attachment member;

a base torsional extension of the second torsional spring is positioned to direct base torsional-spring pressure against the first attachment member in the first rotational direction and to direct torsionally rotative spring pressure of a rotational extension of the second torsional spring in the oppositely second rotational direction against the second attachment member;

wherein the first torsional spring has a first-torsional-spring coil positioned circumferentially on an outside periphery of a spring axle;

the second torsional spring has a second-torsional-spring coil juxtaposed to the first-torsional-spring coil and positioned circumferentially on the outside periphery of the spring axle;

the spring axle is contained in a spring-axle housing attached to the first attachment member;

wherein the axle housing is a pair of U-bolts with a first U-bolt and a second U-bolt;

a U portion of the first U-bolt is extended upwardly from a first side of the first attachment member at a position inwardly from a first edge of the first attachment member;

a U portion of the second U-bolt is extended upwardly from a second side of the first attachment member at a position inwardly from a second edge of the first attachment; and a spring bracket that is generally U-shaped;

with the spring bracket having a base of a first leg attached to a first end of the spring axle, a base of a second leg attached to a second end of the spring axle and a U-shaped central portion that is sized and shaped to be positioned against the second attachment member.

2. A spring-hinged actuator as described in claim 1 wherein:

the rotational extension of the first torsional spring is attached to the first leg of the spring bracket; and the rotational extension of the second torsion spring is attached to the second leg of the spring bracket.

3. A spring-hinged actuator as described in claim 2 wherein: the predetermined condition for release of the releasable tensioner is predetermined heat.

4. A spring-hinged actuator as described in claim 2 wherein: the predetermined condition for release of the releasable tensioner is predetermined bending moment against the releasable tensioner.

5. A spring-hinged actuator as described in claim 2 wherein: the predetermined condition for release of the releasable tensioner is predetermined rotative pressure against an attachment member.

6. A spring-hinged actuator as described in claim 2 wherein: the predetermined condition for release of the releasable tensioner is predetermined sound.

7. A spring-hinged actuator as described in claim 2 wherein: the predetermined condition for release of the releasable tensioner is predetermined vibration.

8. A spring-hinged actuator as described in claim 2 wherein: the predetermined condition for release of the releasable tensioner is predetermined time.

9. A spring-hinged actuator as described in claim 2 wherein: the predetermined condition for release of the releasable tensioner is predetermined ambient pressure.

10. A spring-hinged actuator as described in claim 2 wherein: the predetermined condition for release of the releasable tensioner is predetermined ambient chemical composition.

11. A spring-hinged actuator as described in claim 2 wherein: the predetermined condition for release of the releasable tensioner is predetermined positional change.

12. A spring-hinged actuator as described in claim 2 wherein: the predetermined condition for release of the releasable tensioner is predetermined ambient electrical condition.

13. A spring-hinged actuator as described in claim 2 wherein: the predetermined condition for release of the releasable tensioner is ambient radio waves.

* * * * *